US012629606B2

(12) United States Patent
Duus et al.

(10) Patent No.: US 12,629,606 B2
(45) Date of Patent: May 19, 2026

(54) MODULAR TOY SYSTEM WITH ARC TOY BUILDING ELEMENT

(71) Applicant: LEGO A/S, Billund (DK)

(72) Inventors: Steffen Duus, Billund (DK); Christopher Carver, Billund (DK); Majbritt Janot Nielsen, Billund (DK)

(73) Assignee: LEGO A/S, Billund (DK)

( * ) Notice: Subject to any disclaimer, the term of this patent is extended or adjusted under 35 U.S.C. 154(b) by 226 days.

(21) Appl. No.: 18/754,548

(22) Filed: Jun. 26, 2024

(65) Prior Publication Data

US 2026/0001007 A1 Jan. 1, 2026

(51) Int. Cl.
*A63H 33/08* (2006.01)

(52) U.S. Cl.
CPC ..... *A63H 33/086* (2013.01)

(58) Field of Classification Search
CPC ..... A63H 33/04; A63H 33/06; A63H 33/08; A63H 33/086; A63H 33/088
See application file for complete search history.

(56) References Cited

U.S. PATENT DOCUMENTS

| | | | | |
|---|---|---|---|---|
| 9,669,324 | B2 * | 6/2017 | Roth | A63H 33/08 |
| 9,937,433 | B2 * | 4/2018 | Stolten | A63H 33/10 |
| 12,440,778 | B2 * | 10/2025 | Hafendorfer | A63H 33/044 |
| 12,485,360 | B2 * | 12/2025 | Donahue | A63H 33/086 |
| 2026/0014490 | A1 * | 1/2026 | Hafendorfer | A63H 33/044 |

* cited by examiner

*Primary Examiner* — John A Ricci
(74) *Attorney, Agent, or Firm* — Day Pitney LLP; George Chaclas; Anthony A. Kassas

(57) ABSTRACT

A modular toy system comprising toy building elements including an arc toy building element. The arc toy building element has at least one knob receiving opening formed in a bottom surface or at least one knob formed in a top surface configured for coupling to complimentary coupling elements of another toy building element in a first direction. The arc toy building element also has an arc surface formed as a convex surface on the arc toy building element and extending over a length in a direction parallel to the top surface or to the bottom surface of the arc toy building element, the length is an integer multiple of a modular distance defining the spacing of a regular two-dimensional pattern for the toy building elements.

15 Claims, 8 Drawing Sheets

MODULAR TOY SYSTEM WITH ARC TOY BUILDING ELEMENT

FIELD OF THE DISCLOSURE

The present disclosure relates to a modular toy system and an arc toy element for such a modular toy system.

BACKGROUND

Modular toy systems may comprise toy building elements in modular sizes, where the toy building elements further have complementary coupling elements, allowing releasable interconnection of the toy building elements, such that the toy building elements of the modular toy system may fit together in order to make structures such as toy houses, cars, etc. Such toy building elements typically have one or more knobs formed on a top surface of at least some of the toy building elements and/or one or more knob receiving openings formed in a bottom surface of at least some of the toy building elements. The coupling elements on the toy building elements are arranged in a regular two dimensional pattern on and/or in the toy building elements spaced apart by a modular distance between these knobs or the knob receiving openings.

In the field of modular toy building systems, a number of different types of toy building elements are known. It started with box shaped bricks having complementary coupling elements. Later, toy building elements with a slanted surface (triangular cross-shape (in one plane)) were introduced, allowing to make for example roofs having a slanted side, which was not stepped. For security reasons, avoiding a sharp edge at the intersection between the bottom surface and the slanted surface was desirable. Therefore, a small vertically oriented surface was introduced between the bottom surface and the slanted surface. Later yet, toy building elements having curved surfaces, arches and bows, were also introduced. In order to make the new curved surface toy building elements the earlier toy building elements compatible, the curved surface toy building elements were designed to cooperate with the earlier elements having small vertically oriented surfaces. Therefore, also bows in such curved surface toy building elements will have small vertically oriented surfaces. Therefore, even toy building elements having seemingly circular (actually cylindrical) surfaces, does not necessarily fit other toy building elements. Either there may be an uneven gap between the two, which is displeasing from an esthetical point of view, or the curved shapes cannot be fitted to each other even when they have matching sizes according to the modular system units (modular distance), thereby preventing assembly.

The present disclosure seeks to alleviates both problems, increasing compatibility of toy building elements of various types, where the toy building elements have curved surfaces.

SUMMARY OF THE DISCLOSURE

The objects of the disclosure are achieved by a modular toy system comprising toy building elements, the toy building elements comprising complementary coupling elements in the form of one or more knobs formed on a top surface of at least some of the toy building elements and/or one or more knob receiving openings formed in a bottom surface of at least some of the toy building elements, wherein coupling elements on the toy building elements are arranged to cooperate in a regular two-dimensional pattern on the toy building elements spaced apart by a first modular distance, wherein the toy building elements has a length, which is an integer multiple of the first modular distance, and the toy building elements has a width which is an integer multiple of the first modular distance, and wherein the toy building elements has a height between the bottom surface and the top surface, which is an integer multiple of a second modular distance, and wherein the second modular distance is ⅖ of the first modular distance, wherein the modular toy system comprises an arc toy building element, the arc toy building element comprising at least one knob receiving opening formed in a bottom surface and/or at least one knob formed in a top surface of the of the arc toy building element, which is configured for coupling to complimentary coupling elements of another toy building element in a first direction;

an arc surface formed as a convex surface on the arc toy building element, the arc surface having an axis of curvature, which is perpendicular to the first direction, wherein the arc surface extends over a second length in a direction parallel to the top surface or to the bottom surface of the arc toy building element, and a second height in a direction transverse to the bottom surface or to the top surface of the arc toy building element, wherein the second length is an integer multiple of the first modular distance, wherein the second height is an integer multiple of the second modular distance, wherein a ratio is defined between the integer multiple of the second modular distance of the second height, and the integer multiple of the first modular distance of the second length and, wherein the arc surface has a second length of two-eight modular distances and the second height is 5, 7, 10, 12, 15, 17 or 20-times the second modular distance, and when the ratio is 5/2, the arc surface is a continuously curved surface from the top surface to the bottom surface of the toy arc building element, and when the ratio is different from 5/2, but within an interval of 5/2 minus 10%, the arc surface comprises a vertical planar surface portion and a continuously curved surface portion extending between the vertical planar surface portion and the top surface or the bottom surface, the vertical planar surface portion having a third length, which is equal to the second modular distance.

Hereby, an improved fit with at least certain prior art arch-shaped surfaces is achieved.

In an embodiment, the arc surface is facing away from the bottom surface.

In a further embodiment, the arc toy building element may comprise an arch-shaped surface opposite to the arc-surface.

In a further embodiment, when the arc-surface is a continuously curved surface from the top surface to the bottom surface of the toy arc building element, then the arch-shaped surface comprises a vertical planar surface portion and a continuously curved surface portion extending between the vertical planar surface portion and the bottom surface, and wherein the vertical planar surface portion of the arch-shaped surface having a third length, which is ⅗ times the second modular distance.

In another embodiment, when the arc-surface comprises a vertical planar surface portion and a continuously curved surface portion extending between the vertical planar surface portion and the bottom surface, then the arch-shaped surface is a continuously curved surface.

Alternatively to the previous two embodiments, all arc toy building element of the modular toy system having an arc surface formed as a convex surface and a concave arch-shaped surface opposite to the arc-surface, the arch-shaped surface comprises a vertical planar surface portion and a continuously curved surface portion extending between the vertical planar surface portion and the bottom surface, and wherein the vertical planar surface portion of the arch-shaped surface having a third length, which is ⅗ times the second modular distance.

Thereby a system of toy arc building elements having both arc surfaces and arch-shaped surfaces may be obtained, in which the toy arc building elements of the modular system fits to each other with an improved fit.

In another embodiment, the arc surface is facing away from the top surface.

In an embodiment thereof the arc toy building element comprises an arch-shaped surface opposite to the arc-surface.

In an embodiment thereof, when the arc-surface is a continuously curved surface from the top surface to the bottom surface of the toy arc building element, then the arch-shaped surface comprises a vertical planar surface portion and a continuously curved surface portion extending between the vertical planar surface portion and the bottom surface, and wherein the vertical planar surface portion of the arch-shaped surface having a fourth length, which is in the interval ⅖-17⁄40 times the second modular distance.

In an embodiment thereof, when the arc-surface comprises a vertical planar surface portion and a continuously curved surface portion extending between the vertical planar surface portion and the bottom surface, then the arch-shaped surface is a continuously curved surface.

Thereby a system of toy arc building elements having both arc surfaces and arch-shaped surfaces may be obtained, in which the toy arc building elements of the modular system fits to each other with an improved fit.

Alternatively to the previous two embodiments, all arc toy building element of the modular toy system having an arc surface formed as a convex surface and a concave arch-shaped surface opposite to the arc-surface, the arch-shaped surface comprises a vertical planar surface portion and a continuously curved surface portion extending between the vertical planar surface portion and the bottom surface, and wherein the vertical planar surface portion of the arch-shaped surface has a fourth length, which is in the interval ⅖-17⁄40 times the second modular distance Throughout this text the arc surface may also be called a bow surface.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the disclosure will be described in greater detail with reference to embodiments shown by the enclosed figures. It should be emphasized that the embodiments shown are used for example purposes only and should not be used to limit the scope of the disclosure.

DETAILED DESCRIPTION OF THE EMBODIMENTS

Figure 1A:
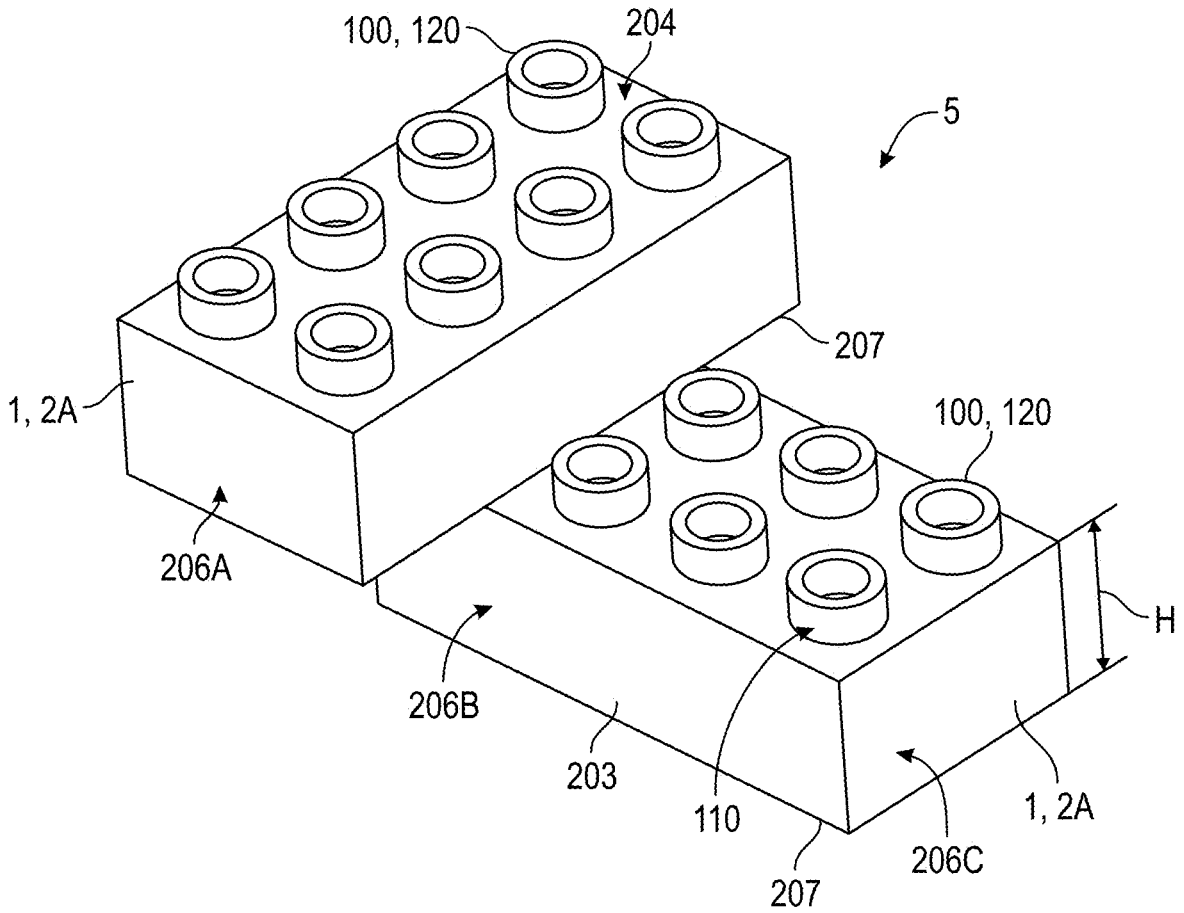
FIG. 1A (Prior Art)
FIG. 1A, in a perspective view, illustrates a two prior art toy building elements of a modular toy construction system, where the two toy building elements connected/coupled to each other, FIG. 1B, in a bottom view, shows a prior art toy building element of FIG. 1A from below.
Figure 1B:
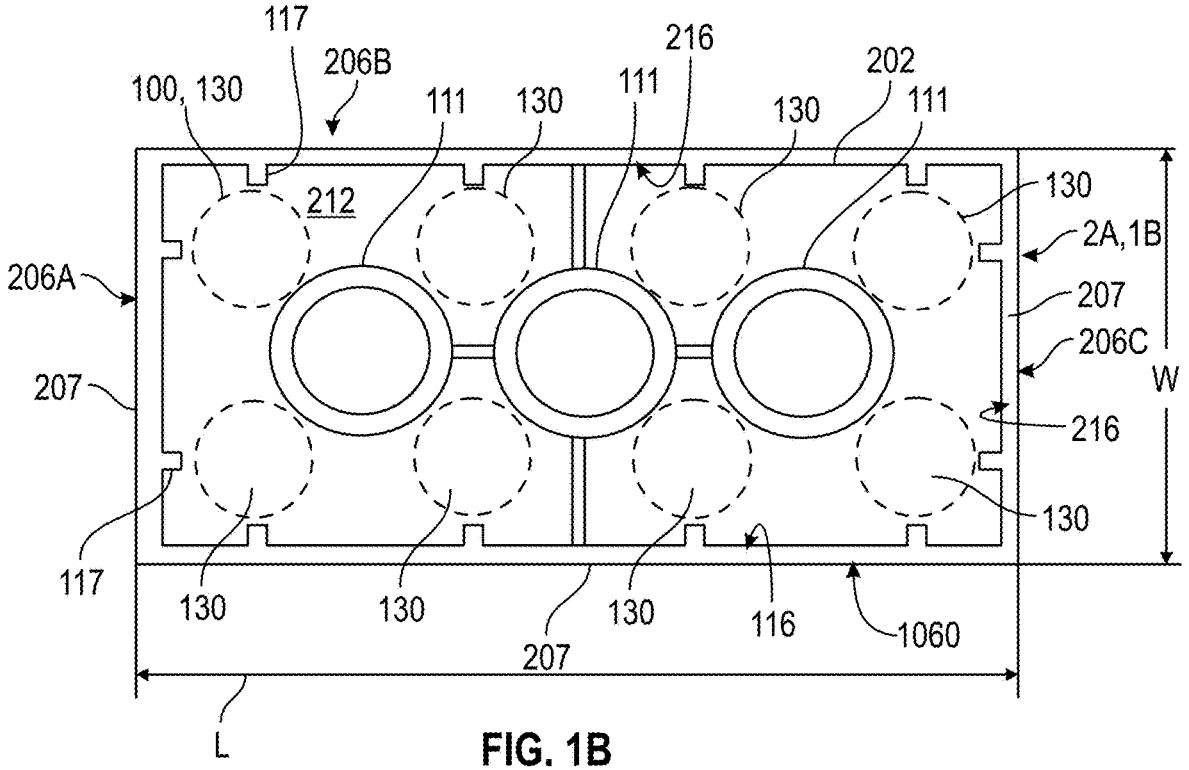
FIG. 1B (Prior Art)
FIG. 1C, in a partly sectional view, shows the two toy building elements of FIG. 1A, in a situation where the two toy building elements are in the process of being coupled to each other or being disconnected from each other.
Figure 1C:
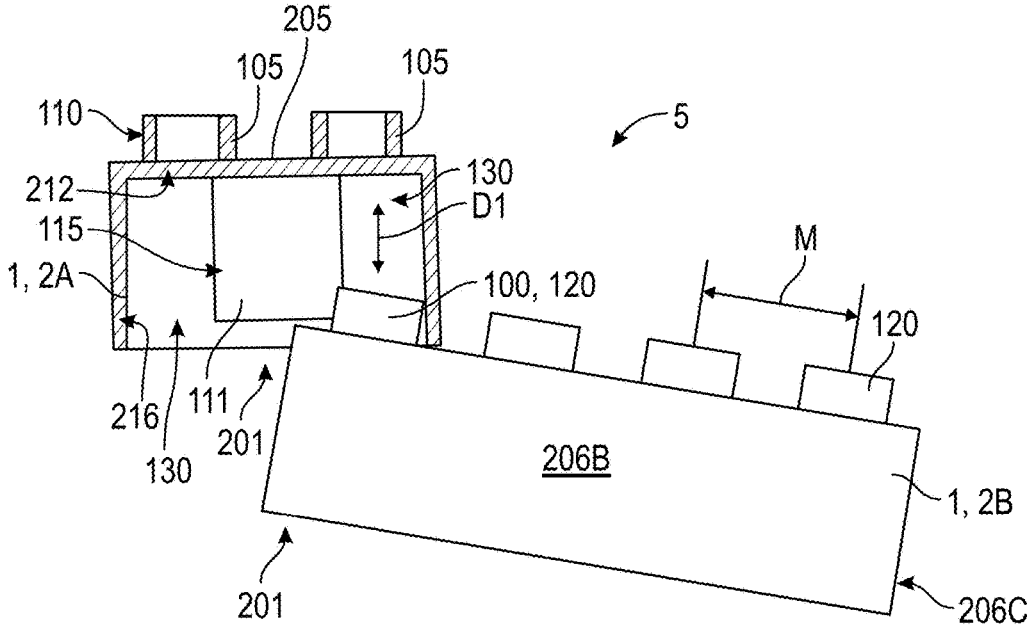
FIG. 1C (Prior Art)

FIGS. 1A-C shows an example of prior art building elements or toy building elements 1, 2A, 2B of a modular toy system S. A modular toy system S of this kind may also be called a modular toy building system or modular toy constructions system and the like. Toy building elements 1, 2A, 2B may also be called toy construction elements. Such toy building elements 1, 2A, 2B of a modular construction system 10 are often formed in polymer material such as plastic, and typically in an injection moulding process.

FIGS. 1A and 1C show two essentially identical toy building elements 2A, 2B in the shape of building blocks. Each of these toy building elements 2A, 2B comprises a body part 203 with a top surface 204 on which eight connectors or coupling elements 100 are configured. The coupling elements 100 are cylindrical connectors, studs or knobs 120. The coupling elements 100 are formed on the building elements 2A, 2B in a regular two-dimensional lattice or grid, in this case a 2×4 grid. The coupling elements 100 comprises a body 105 having an outer cylindrical surface 110.

The body part 203 of the building elements 2A, 2B comprises sidewalls 206A, 206B, 206C, and 206D are configured with a lowermost edge 207 that forms a resting surface or lower surface or bottom surface 201 for the building elements 2A, 2B.

Toy building elements 2A, 2B of the type shown in FIGS. 1A-C further comprises a set of cylinders 111 extending downward from a lower surface 212 of a top wall 205 connecting the sidewalls 206A-D of the building element 2A, 2B. Between inner surfaces 216 of the sidewalls 6A-D and outer surfaces 115 of the one or more cylinders 111, knob receiving openings 130 are formed.

The knobs 120 and the knob receiving openings 130 are configured for cooperating to releasably attach to each other, in a pressure/interference fit. Therefore, a knob 120 and a knob receiving opening 130 are complimentary coupling elements 100.

Building elements 2A, 2B of the type shown in FIG. 1A-C are connected to each other in an interference fit (pressure fit) by the sidewalls 206A, 206B, 206C, and 206D on the uppermost building element 2A being pressed outwards, when the sidewalls 6A, 6B, 6C, and 6D are pressed down on the knobs 120 on the lowermost building element 2B, following which, the sidewalls 206A-D press against the knobs 120 on the lowermost building element 2B and on an outer surface 115 of the cylinders 111.

Elongate ribs 117 may as shown in FIG. 1B, extend outward from an inner surface 116 of the sidewalls 6A-D and be formed from the lower surface 212 of the top wall 205 all the way to the lower edge 207. The elongate ribs 117 may constitute the contact between the knob 120 and the sidewalls 206A-D. In FIG. 1B, showing a toy building element 2A, 2B from below, knobs 120 of a second coupled toy building element is illustrated in dashed line. Each of the knobs 120 of a 2×4 toy building element 2A, 2B is inserted into individual knob receiving openings 130 of the shown toy building element 2A, 2B.

FIG. 1C shows two toy building elements 2A and 2B as described above, where the two toy building element are in the process of either being coupled to or being de-coupled from, each other, from or to a coupled situation as e.g. shown in FIG. 1A.

In the view shown in FIG. 1C, the upper toy building element 2A is shown in a sectional view perpendicular to a longitudinal direction of the toy building element 2A. The lowermost toy building element is shown in side-view. The view allows to appreciate how a knob 120 of one toy building element 2B engages with a portion of an inner surface 116 of a sidewall 206A-D of the toy building element 2A and an outer surface 115 of a cylinder 111 of the other toy building element 2A.

In order to connect the toy building elements 2A and 2B, the knob 120 and the knob receiving openings 130 must be connected to each other in a first direction (or coupling direction) indicated by the arrow in FIG. 1C.

Cylindrical connectors or coupling elements 100 such as the knobs 120 and knob receiving openings 130 formed on building elements 2A, 2B in a regular two-dimensional lattice, such as shown in FIGS. 1A-C, forms the basis of a plurality of modular construction systems known in the art.

In general, toy building elements 1, 2A, 2B, 10 comprises complementary coupling elements 100 in the form of one or more knobs 120 formed on a top surface 1', 104 of at least some of the toy building elements 1,2A, 2B, 10. In general, toy building elements 1, 2A, 2B, 10 may also comprise one or more knob receiving openings 130 formed in a bottom surface 201, 1" of at least some of the toy building elements 1,2A, 2B, 10. In general, toy building elements 1, 2A, 2B, 10 may either have knobs 120 on the top surface or knob receiving openings 130 formed in the lower surface, or both. It will further be appreciated that some constructions elements may have further knobs and/or knob receiving openings on other surfaces in special cases, or they may comprise complementary connectors of other types known in the art.

As also mentioned above, the coupling elements 100 on the toy building elements 1, 2A, 2B, 10 are arranged to in a regular two-dimensional pattern on the toy building elements 1, 2A, 2B, 10. The coupling elements 100 are spaced apart by a first modular distance, M, in each direction of the plane or surface on which they are located. This is easy to appreciate from the 2×4 building elements shown in FIGS. 1A-C. However, it will further be appreciated that even if building elements 1 of the modular toy system S comprises only one coupling elements 100, this will be arranged on the building elements 1, such that the building element 1 will fit into the regular two-dimensional pattern to connect with other toy building elements 1 having complementary coupling elements 100.

In general, the toy building elements 1, 2A, 2B, 10 has a length L, which is an integer of the first modular distance M, and a width W, which is an integer of the first modular distance M.

The toy building elements 1, 2A, 2B, 10 has a height, H, as defined between the bottom surface 201, 1" and the top surface 1', 204. In general, the height, H, is an integer of a second modular distance. P. For the present type of modular toy systems, S, the second modular distance is ⅔ of the first modular distance, M.

Figure 2:
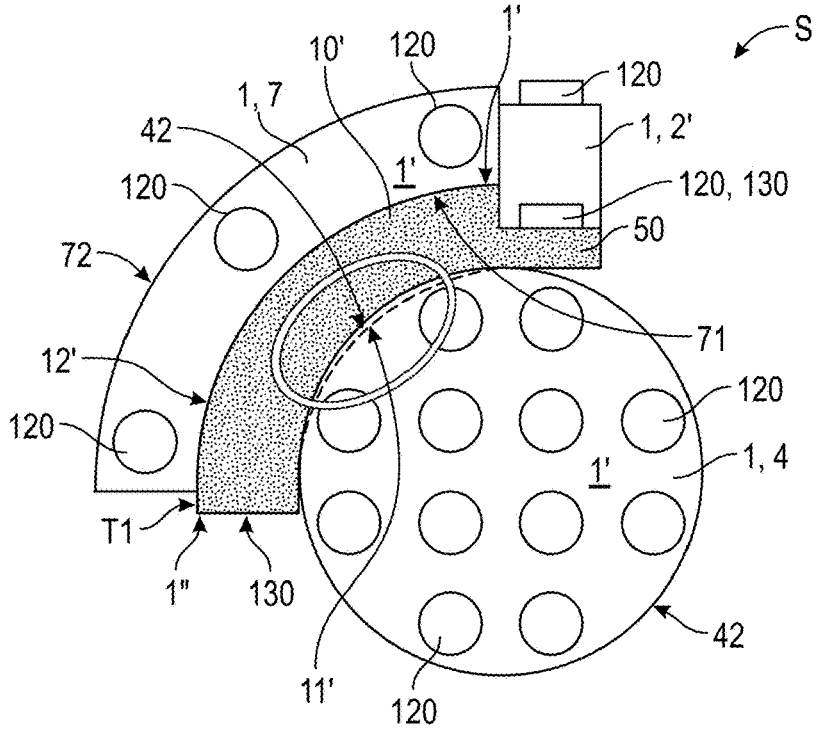
Fig. 2 (Prior Art)
FIG. 2 illustrates a combination of prior art toy building elements including a prior art arc toy building element, having and arch and a convex arc and illustrating the possible incompatibility in combining such an arc toy building element with other toy building elements.

Turning now to FIG. 2, showing other types of prior art modular toy building elements 1, 2', 4, 7, 10', than in FIGS. 1A-C. In FIG. 2 the prior art modular toy building elements are combined to form a structure or part of a structure.

The modular toy building element 2' is 1×1 first modular distance, M, i.e. it has 1 knob 120 formed in a top surface 1' and one knob receiving opening 130 formed in a bottom surface 1", and a length, L, and width W of 1 modular distance. The modular toy building element 2' has a height, H, of three second modular distances, P, as defined above. The 1×1 modular toy building element 2' is connected via it's knob receiving opening 130 opening to a knob 120 formed on a prior art toy arc building element 10'.

The toy arc building element 10' of FIG. 2 comprises an arch-shaped surface 11' formed as a concave surface in the arc toy building element 10', the arc-shaped surface 11' having an axis of curvature, A1 (see FIG. 5), which is perpendicular to the first direction, D1, defined by the knobs and knob receiving openings, 120, 130. The arch-shaped surface 11' is generally circular or rather cylindrical or partly cylindrical as it stretches over a quarter of a complete cylinder.

The arc toy building element 10' in this case also comprises a convex arc surface 12' formed as a convex surface on the arc toy building element 10' opposite to the arc-shaped surface 11'. The convex arc surface 12' also has an axis of curvature, A1 (see FIG. 5), which is perpendicular to the first direction, D1. As with the arc-shaped surface 11', the convex arc surface 12' is generally circular or rather cylindrical or partly cylindrical as it stretches over a quarter of a complete cylinder.

The arc toy building element 10' has a bottom surface 1" and a top surface 1' or uppermost surface. The top surface 1' in this case is provided by the upper right hand portion of the bow surface 12'. In this case, no knob 120 is formed on the top surface 1'. Instead, a knob 120 is arranged on a plate shaped extension 50. A knob receiving opening 130 (not shown in FIG. 2) may be provided in the bottom surface 1 of this plate shaped extension. Further, a knob receiving opening 130 (not shown in FIG. 2) may be provided in the bottom surface 1" of the arc toy building element 10'.

Also shown in FIG. 2, is a curved prior art toy building element 7, having a concave arch-shaped surface 71 and opposite thereto a convex arc surface 72. The curved prior art toy building element 7 is seen from above, looking into the top surface 1' thereof. A total of three knobs is provided on the top surface 1'. Thus, for the curved prior art toy building element 7, the coupling direction/first direction D1 is perpendicular to the coupling direction D1 of the arc toy building element 10', when they are oriented as shown. The concave arch-shaped surface 71 and the convex arc surface 72 of the curved prior art toy building element 7 are coaxial with the first direction/coupling direction, D1.

It will be appreciated that the concave, arch-shaped surface 71 fits snuggly with the outer convex arc surface 12' of the arc toy building element 10'. Such a fit is however not possible for all prior art toy building elements 1.

Also shown in FIG. 2, is a cylindrical prior art toy building element 4. The cylindrical prior art toy building element 4 is seen from above, looking into the top surface 1' thereof. A total of 6 knobs is provided on the top surface 1'. Thus, for the cylindrical prior art toy building element 4 the coupling direction/first direction is perpendicular to the coupling direction D1 of the arc toy building element 10', when they are oriented as shown. The cylindrical prior art toy building element 4 has a cylindrical outer surface 42, which is coaxial with the first direction/coupling direction.

Due to the prior art design, the arch-shaped surface 11' of the arc toy building element 10' does not match the cylindrical outer surface 42 completely. In FIG. 2, at the intersection between the arc toy building element 10' and the cylindrical prior art toy building element 4, the arch-shaped surface 11' of the arc toy building element 10' is shown in dashed line, and the cylindrical outer surface 42 of the cylindrical prior art toy building element 4 is shown in solid line. It can be seen that the two curved surfaces will overlap if a user tries to match them as seen in the area marked by an oval F. Therefore, mating of the two prior art toy building elements (4, 10') is not possible fitting within the first modular distance system.

Figure 3:
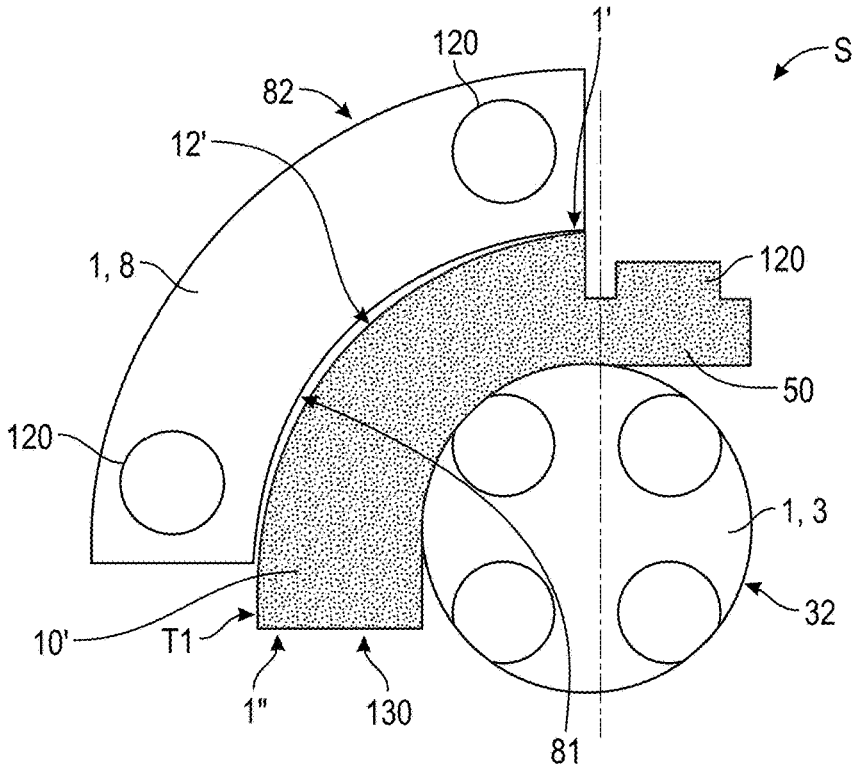
Fig. 3 (Prior Art)
FIG. 3 illustrates another combination of prior art toy building elements including a prior art arc toy building element, having and arch and a convex arc and illustrating the possible incompatibility in combining such an arc toy building element with other toy building elements FIG. 4, in a side view, shows a prior art arc art toy building element with convex arc surface and a prior art vertically arranged surface.

Turning now to FIG. 3, showing other types of prior art modular toy building elements 1, 3, 8, 10', than in FIGS. 1A-C, and a smaller prior art toy arc building element 10' than in FIG. 2. In FIG. 3 the prior art modular toy building elements 1 are also combined to form a structure or part of a structure.

The toy arc building element 10' of FIG. 3 comprises an arch-shaped surface 11' formed as a concave surface in the arc toy building element 10', the arc-shaped surface 11' having an axis of curvature, A1 (see FIG. 5), which is perpendicular to the first direction, D1, defined by the knobs and knob receiving openings, 120, 130. The arch-shaped surface 11' is generally circular or rather cylindrical or partly cylindrical as it stretches over a quarter of a complete cylinder.

The arc toy building element 10' in this case also comprises a convex arc surface 12' formed as a convex surface on the arc toy building element 10' opposite to the arc-shaped surface 11'. The convex arc surface 12' also has an axis of curvature, A1 (see FIG. 5), which is perpendicular to the first direction, D1. As with the arc-shaped surface 11', the convex arc surface 12' is generally circular or rather cylindrical or partly cylindrical as it stretches over a quarter of a complete cylinder.

The arc toy building element 10' has a bottom surface 1" and a top surface 1' or uppermost surface. The top surface 1' in this case is provided by the upper right hand portion of the bow surface 12'. In this case, no knob 120 is formed on the top surface 1'. Instead, a knob 120 is arranged on a plate shaped extension 50. A knob receiving opening 130 (not shown in FIG. 3) may be provided in the bottom surface 1 of this plate shaped extension as well. Further, a knob receiving opening 130 (not shown in FIG. 3) may be provided in the bottom surface 1" of the arc toy building element 10'.

Also shown in FIG. 3, is a curved prior art toy building element 8, having a concave arch-shaped surface 81 and opposite thereto a convex arc surface 82. The curved prior art toy building element 8 is seen from above, looking into the top surface 1' thereof. A total of two knobs is provided on the top surface 1'. Thus, for the curved prior art toy building element 8, the coupling direction/first direction D1 is perpendicular to the coupling direction D1 of the arc toy building element 10', when they are oriented as shown. The concave arch-shaped surface 81 and the convex arc surface 82 of the curved prior art toy building element 8 are coaxial with the first direction/coupling direction, D1.

It will be appreciated that the concave, arch-shaped surface 81 and the outer convex arc surface 12' of the arc toy building element 10' does not fit very well, a gap therebetween occurring due to the vertically oriented first transition, T1, and the relationship between the height and length components of the convex arc surface 12'. Thus, for many prior art convex arc surfaces 12' it not possible to provide a good fit between the two.

For upwardly convex arc surfaces as shown in FIGS. 2 and 3, the vertically oriented first transition surface, T1, was sized to accommodate for a knob height, but smaller than a second modular distance, P.

Also shown in FIG. 3, is a cylindrical prior art toy building element 3. The cylindrical prior art toy building element 3 is seen from above, looking into the top surface 1' thereof. A total of four knobs is provided on the top surface 1'. Thus, for the cylindrical prior art toy building element 3, the coupling direction/first direction is perpendicular to the coupling direction D1 of the arc toy building element 10', when they are oriented as shown. The cylindrical prior art toy building element 4 has a cylindrical outer surface 32, which is coaxial with the first direction/coupling direction D1.

Due to the prior art design, the arch-shaped surface 11' of the arc toy building element 10', to match with the convex arc surface 12, the arch-shaped surface 11' does allow the not match the cylindrical outer surface 32 in a way that aligns with the modularity of the first modular distance system, as indicated by the dashed line.

Figure 4:
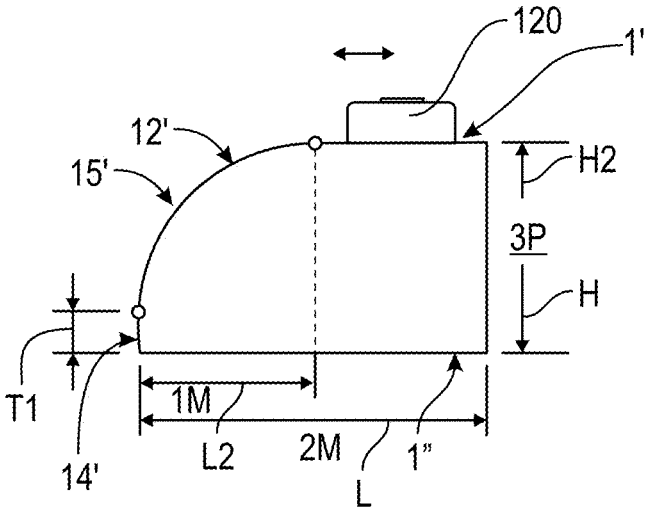
FIG. 4 (Prior Art)

FIG. 4 shows a prior art toy arc building element 10' having one arc surface 12', formed as a convex surface on the prior art arc toy building element 10'. The prior art toy arc building element 10' fulfills the requirements of the general toy building elements described above.

Further, the prior art toy arc building element 10' comprises at least one knob receiving opening 130 formed in a bottom surface 1" thereof. In this case the prior art toy arc building element 10' comprises two knob receiving openings 130. However, these are not explicitly shown in FIG. 4. As shown, the prior art toy arc building element 10' further comprises one knob 120 formed in a top surface 1' of the prior art arc toy building element 10': The knob receiving openings 130 and the knobs 120 are configured for coupling to complimentary coupling elements 100 of another toy building element 1, 2A,2B, 2', 3, 4, 5, 7, 10', 10, in a first direction D1 for example as described in connection with FIG. 1C above.

Figure 5:
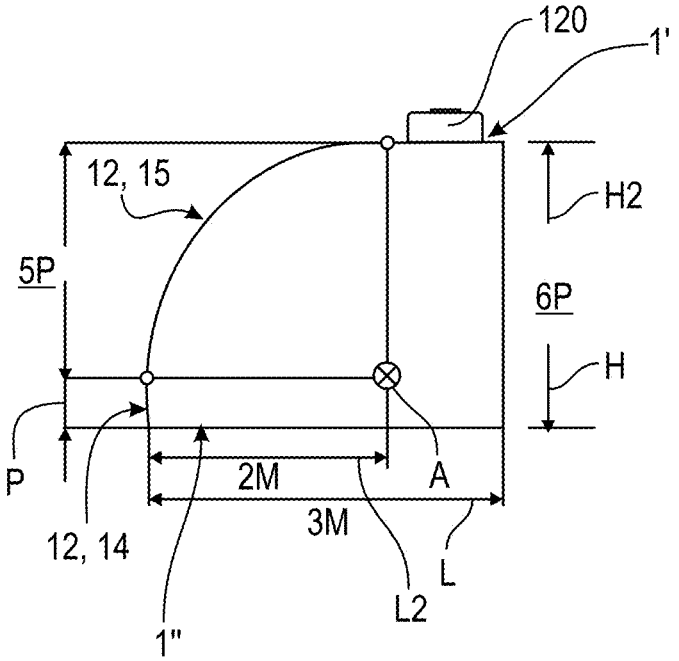
FIG. 5 shows an arc toy building element according to one embodiment of the disclosure, the toy arc building element comprising a convex arc surface.

The arc surface 12' of the prior art arc toy building element 10' has an axis of curvature A1, which is perpendicular to the first direction D1. The axis of curvature A1 is illustrated in FIG. 5.

The arc surface 12 of the prior art arc toy building element 10' further extends over a second length L2 in a direction parallel to the bottom surface 1" of the arc toy building element 10. Further, the arc surface 12 of the prior art arc toy building element 10' extends over a second height, H2, in a direction transverse to the bottom surface 1" of the prior art arc toy building element 10'.

The second length L2 is an integer multiple m of the first modular distance M, and the second height H2 is an integer multiple p of the second modular distance P.

The arc surface 12' of the prior art arc toy building element 10' is formed in two sections, a vertical planar surface portion 14' and a continuously curved surface portion 15'. The vertical planar surface portion 14' extends between the bottom surface 1" and the continuously curved surface portion 15'. The continuously curved surface portion 15' extends between the vertical planar surface portion 14' and the top surface 1'. The vertical planar surface portion 14' has a length T1. The length T1 is set to accommodate the height of a standard knob, which in for example the standard LEGO System® is 1.7 mm. The length T2 is set to 1.92 mm in this system. This corresponds to ⅗ of the second modular distance, P, which in the LEGO System® is 3.2 mm. In the LEGO System® the first modular distance is 8 mm.

It is clear that the length T2 set at 1.92 mm could be different. It is a choice stemming from the wish for combinability with other toy building elements such as the roof toy building element discussed above.

Figure 10:
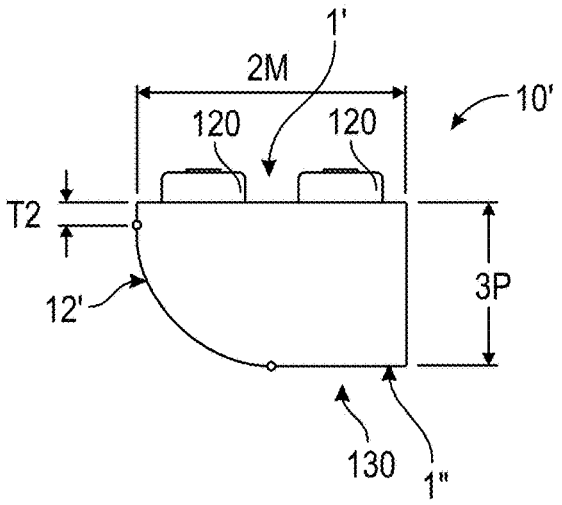
FIG. 10 (Prior Art)
FIG. 10, in a side view, shows a prior art arc art toy building element with an inverted convex arc surface and a prior art vertically arranged transition surface between the top surface and the curved surface.

Another, prior art building element 10' having one arc surface 12', formed as a convex surface on the prior art arc toy building element 10' is shown in FIG. 10. This prior art building element 10' but differs in that the arc surface 12' faces away from a top surface 1' of the prior art building element 10'.

Also the arc surface 12 of the prior art arc toy building element 10', shown in FIG. 10, is formed in two sections, a vertical planar surface portion 14' and a continuously curved surface portion 15'. In this case, the vertical planar surface portion 14' extends between the top surface 1' and the continuously curved surface portion 15'. The continuously curved surface portion 15' extends between the vertical planar surface portion 14' and the bottom surface 1", and has a length T2. The length T2 is arbitrarily set, but has been chosen to smaller than the length, T1, of the prior art toy arc building element 10' shown in FIG. 4. In for example the standard LEGO System®, the length T2 is set to 1.32 mm in this system. Generally, in order to fit the current uses in the LEGO System®, the length T2 is set in the interval ⅖-17/40 times the second modular distance. P.

As mentioned above, these choices have the effect that some curved surfaces cannot be matched together within the modular system, S.

Figure 11:
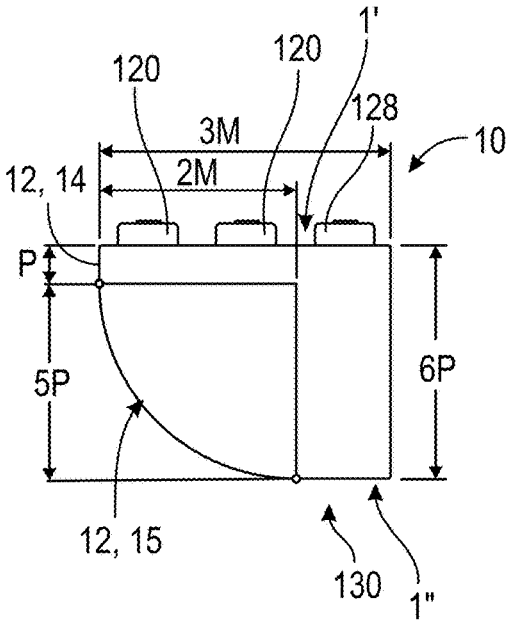
FIG. 11, an arc toy building element according to an embodiment of the disclosure, the toy arc building element comprising an inverted convex arc surface.

A better compatibility in mating curved surfaces is achieved by constructing, toy building elements having an arc surface 12—an arc toy building element 10 according to the disclosure. This may be exemplified by the embodiments shown in FIGS. 5 and 11. FIGS. 5 and 11 both show embodiments of a toy arc building element 10 having one arc surface 12, which is formed as a convex surface on the arc toy building element 10'.

The arc surface 12 in the embodiment shown in FIG. 5 faces away from the bottom surface 1" of the toy arc building element 10. The arc surface 12 in the embodiment shown in FIG. 11 faces away from the top surface 1'.

The prior art toy arc building element 10' of both embodiments fulfills the requirements of the general toy building elements described above with respect to modularity.

Further, in the FIG. 5 embodiment, the toy arc building element 10 comprises at least one knob receiving opening 130 formed in a bottom surface 1" thereof. In this case the toy arc building element 10 comprises three knob receiving openings 130. However, these are not explicitly shown in FIG. 5. As shown, the toy arc building element 10 further comprises one knob 120 formed in a top surface 1' of the arc toy building element 10. The knob receiving openings 130 and the knobs 120 are configured for coupling to complimentary coupling elements 100 of another toy building element 1, 2A,2B, 2', 3, 4, 5, 7, 10', 10, in a first direction D1 for example as described in connection with FIG. 1C above.

In the FIG. 11 embodiment, the toy arc building element 10 comprises a knob receiving opening 130 formed in a bottom surface 1" thereof. In this case the toy arc building element 10 comprises one knob receiving openings 130. However, this is not explicitly shown in FIG. 11. As shown, the toy arc building element 10 further comprises three knobs 120 formed on a top surface 1' of the arc toy building element 10. The knob receiving opening 130 and the knobs 120 are configured for coupling to complimentary coupling elements 100 of another toy building element 1, 2A,2B, 2', 3, 4, 5, 7, 10', 10, in a first direction D1 for example as described in connection with FIG. 1C above.

In both embodiments, the arc surface 12 of the arc toy building element 10' has an axis of curvature A1, which is perpendicular to the first direction D1. The axis of curvature A1 is illustrated in FIG. 5.

The arc surface 12 of the arc toy building element 10 shown in FIG. 5 further extends over a second length L2 in a direction parallel to the bottom surface 1" of the arc toy building element 10. Further, the arc surface 12 of the arc toy building element 10' extends over a second height, H2, in a direction transverse to the bottom surface 1" of the arc toy building element 10'.

Correspondingly, the arc surface 12 of the arc toy building element 10 shown in FIG. 11 extends over a second length L2 in a direction parallel to the top surface 1' of the arc toy building element 10. Further, the arc surface 12 of the arc toy building element 10' extends over a second height, H2, in a direction transverse to the top surface 1' of the arc toy building element 10.

In both embodiments, the second length L2 is an integer multiple m of the first modular distance M, and the second height H2 is an integer multiple p of the second modular distance P.

In the embodiment of FIG. 5, instead of the arc surface 12' of the prior art arc toy building element 10' being formed in two sections, a vertical planar surface portion 14' of the length T1, as in the FIG. 10 embodiment, and a continuously curved surface portion 15', in this embodiment, the arc surface 12 comprises another vertical planar surface portion 14 extending between the bottom surface 1" and the continuously curved surface portion 15. The continuously curved surface portion 15 extends between the vertical planar surface portion 14 and the top surface 1'. Contrary to the prior art toy arc building element 10' in FIG. 4, the length, third length L3 of the vertical planar surface portion 14 is the same as the second modular distance P.

In the embodiment of FIG. 11, instead of the arc surface 12' of the prior art arc toy building element 10' being formed in two sections, a vertical planar surface portion 14' of the length T2, as in the FIG. 10 embodiment, and a continuously curved surface portion 15', in this embodiment, the arc surface 12 comprises another vertical planar surface portion 14 extending between the top surface 1" and the continuously curved surface portion 15. The continuously curved surface portion 15 extends between the vertical planar surface portion 14 and the bottom surface 1'. Contrary to the prior art toy arc building element 10' in FIG. 10, the length, third length L3 of the vertical planar surface portion 14 is the same as the second modular distance P.

Figure 7:
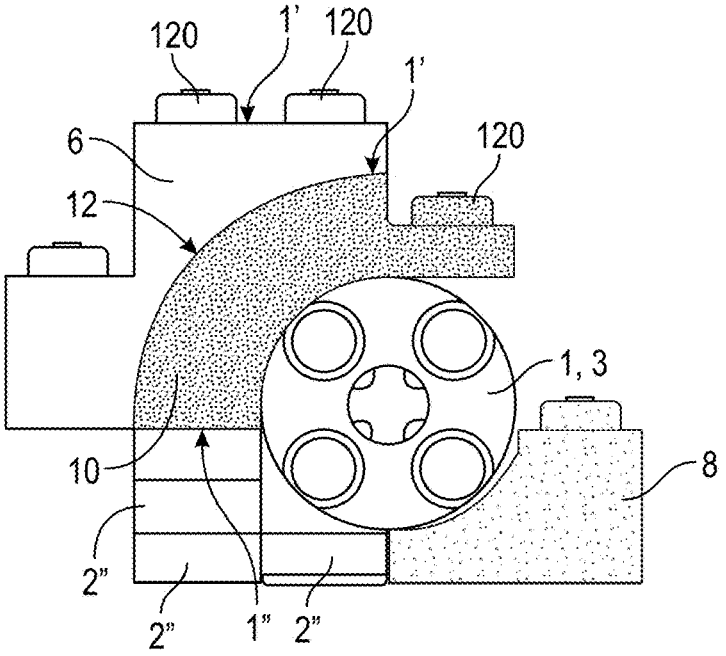
FIG. 7 illustrate a combination of three toy arc building elements according to various embodiments of the disclosure with prior art toy building elements.

By changing the third length, L3, of the vertical planar surface portion 14 from T1 or T2 to the second modular distance P a better fit between the arc surface 12 of the respective embodiments, shown in FIGS. 5 and 11 and other toy building elements, for instance the toy building element 6 in FIG. 7.

In the more general case, the disclosure can be applied to make new better fitting toy arc building elements 10, by following the rules specified below, and explained in connection with the system of toy arc building elements 10 of FIGS. 6A-B and FIG. 12, respectively.

Firstly, however, a ratio R may be is defined between the integer multiple, p, of the second modular distance, P, of the second heigh, H2, and the integer multiple m of the first modular distance, M, of the second length, L2.

Thus, R=p/m.

Based on this, a new toy arc building elements 10 may be dimensioned such that the when the arc surfaces 12 has a second length L2 of one of two-eight modular distances M, and the second height H2 is one of 5, 7, 10, 12, 15, 17 or 20-times the second modular distance P, then 1. when the ratio, R=p/m is 5/2 (R=p/m=5/2), the arc surface 12 is a continuously curved surface 13 from the top surface 1' to the bottom surface 1" of the toy arc building element 10, and
2. when the ratio R is different from 5/2, but within an interval of 5/2 minus 10%, the arc surface 12 comprises a vertical planar surface portion 14 and a continuously curved surface portion 15 extending between the vertical planar surface portion 14 and the top surface 1' or the bottom surface 1", the vertical planar surface portion 14 having a third length L3, which is equal to the second modular distance P.

The embodiments of FIGS. 5 and 11 are constructed from the second clause. In FIGS. 16A-B and 12 examples of both of the above two clauses are shown.

Thereby, a toy system S with toy arc building elements 10 of various dimensions may be obtained, where an improved fit all of the variously dimensioned toy arc building elements 10 is achieved.

Figure 6A:
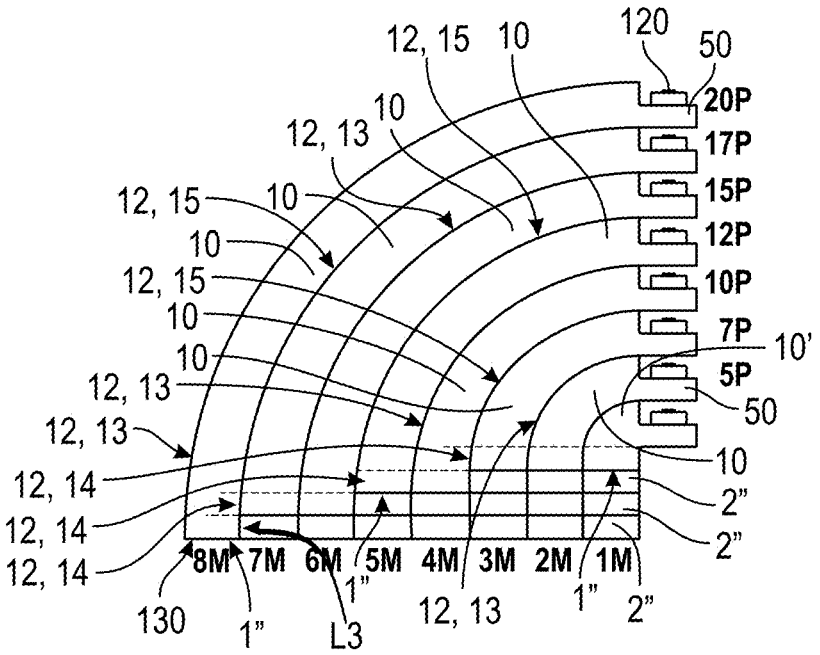
FIG. 6A, shows a system of arc toy building elements according to embodiments of the disclosure, where each of the arc toy building elements comprises a convex arc surface and an arched surface opposite thereto, and where the arc toy building elements are located with a convex arc surface inside an neighbouring arch-shaped surface, ordered by size relating to the first modular distance and mating with each other.
Figure 6B:
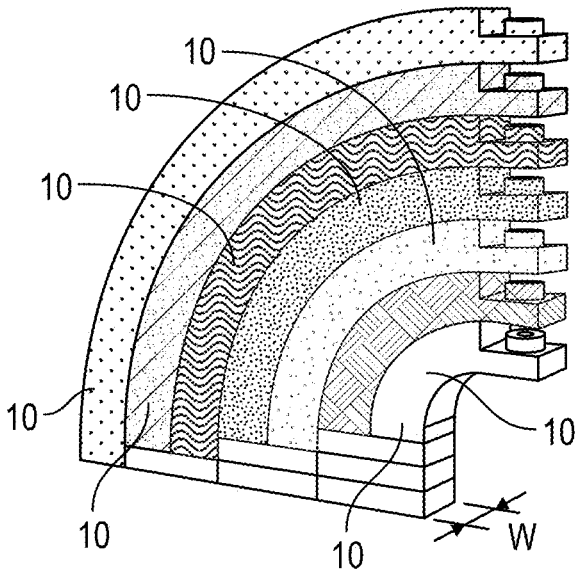
FIG. 6B, shows the system of arc toy building elements of FIG. 6A in a perspective view.

FIGS. 5 and 6A-B shows embodiments, wherein the arc surface 12 of the toy arc building elements 10 faces away from a bottom surface 1" of the toy arc building elements 10.

Figure 12:
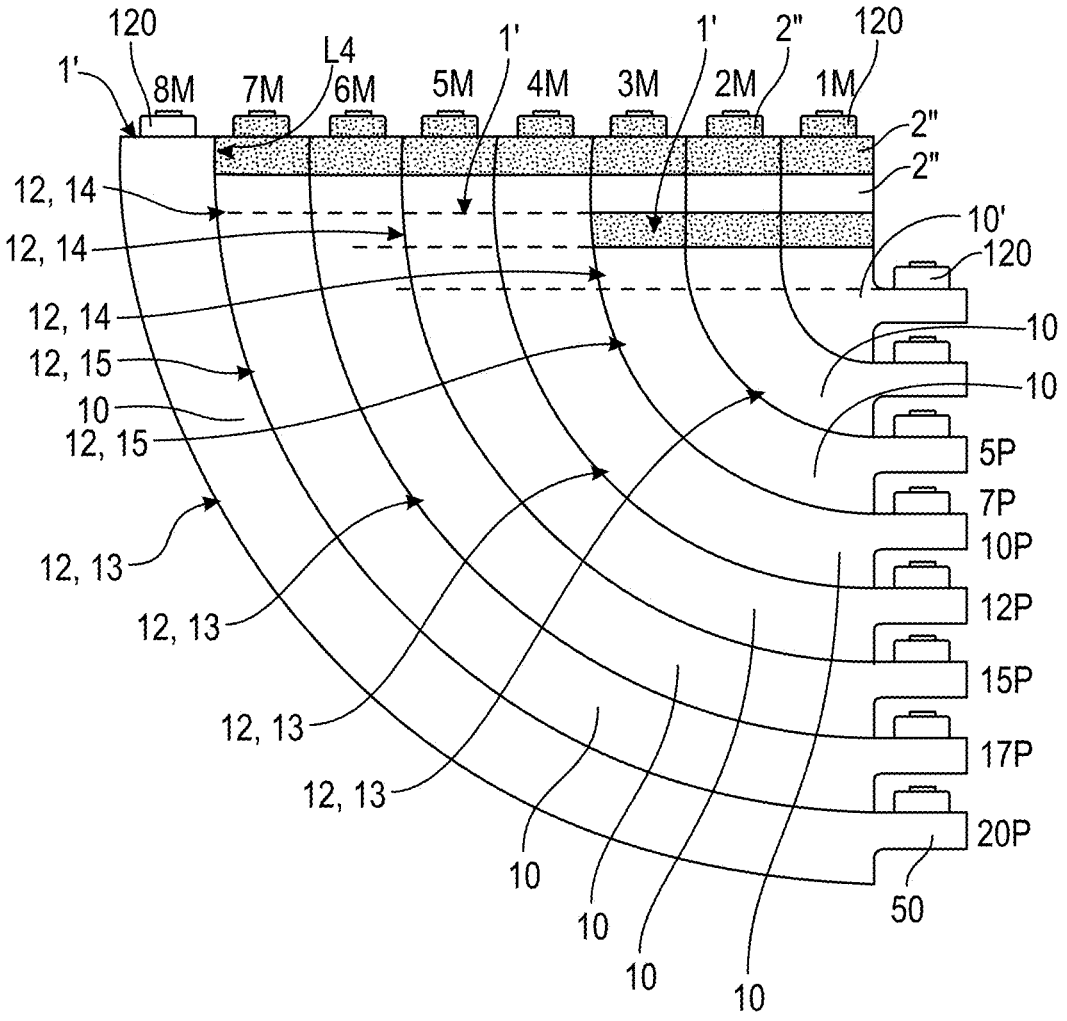
FIG. 12 shows a system of arc toy building elements according to embodiments of the disclosure, where each of the arc toy building elements comprises an inverted convex arc surface and an inverted arched surface opposite thereto, and where the arc toy building elements are located arch to convex arc, ordered by size relating to the first modular distance.

FIGS. 11 and 12 shows embodiments, wherein the arc surface 12 of the toy arc building elements 10 faces away from a top surface 1' of the toy arc building elements 10, i.e. it shows an arc surface 12 which is inverted relative to that of the embodiments shown in FIGS. 5 and 6A-B.

In either case, in further embodiments, the arc toy building element 10 may comprises an arch-shaped surface 11 opposite to the arc-surface 12, as shown in FIGS. 6A-B, and FIG. 12.

When the arc toy building element 10 comprises an arch-shaped surface 11 opposite to the arc-surface 12, and the arc surface 12 of the toy arc building element 10 faces away from the bottom surface 1" of the toy arc building elements, and when the arc-surface 12 is a continuously curved surface 13 a from the top surface 1' to the bottom surface 1" of the toy arc building element 10 as defined by the clauses above, then the arch-shaped surface 11 preferably comprises a vertical planar surface portion and a continuously curved surface portion extending between the vertical planar surface portion and the bottom surface 1". In this case the vertical planar surface portion of the arch-shaped surface 11 has a third length L3, which is ⅗ times the second modular distance P.

When the arc toy building element 10 comprises an arch-shaped surface 11 opposite to the arc-surface 12, and the arc surface 12 of the toy arc building element 10 faces away from the bottom surface 1" of the toy arc building elements, and when the arc-surface 12 comprises a vertical planar surface portion 14 and a continuously curved surface portion 15 extending between the vertical planar surface portion 12 and the bottom surface 1" as defined by the clauses above, then the arch-shaped surface 11 is formed as continuously curved surface.

When the arc toy building element 10 comprises an arch-shaped surface 11 opposite to the arc-surface 12, and the arc surface 12 of the toy arc building element 10 faces away from the top surface 1' of the toy arc building element, and when the arc-surface 12, and when the arc-surface 12 is a continuously curved surface 13 from the top surface 1' to the bottom surface 1" of the toy arc building element 10, as defined by the clauses above, then the arch-shaped surface 11 is further formed with a vertical planar surface portion and a continuously curved surface portion extending between the vertical planar surface portion and the bottom surface 1". In this case the vertical planar surface portion of the arch-shaped surface 11 has a fourth length, L4, which is in the interval ⅖-17⁄40 times the second modular distance, P.

When the arc toy building element 10 comprises an arch-shaped surface 11 opposite to the arc-surface 12, and the arc surface 12 of the toy arc building element 10 faces away from the top surface 1' of the toy arc building elements, and when the arc-surface 12 comprises a vertical planar surface portion 14 and a continuously curved surface portion 15 extending between the vertical planar surface portion 12 and the bottom surface 1" as defined by the clauses above, then the arch-shaped surface 11 is formed as continuously curved surface.

It will further be appreciated that according to the principles described above separate toy building elements having only an arch-shaped surface 11 (and no arc surface may be formed. This is exemplified by the toy building elements 68, 9, 9', 9" and 9''' shown in FIGS. 7-9.

In such embodiments, the shape of the arch-shaped surface 11 is determined base on the previous paragraphs, based upon the dimensions (first modular distance, M, and second modular distance, P) of the arc surface 12, the arch-shaped surface is designed to cooperate/math with.

Thus, if the toy building element having an arch-shaped surface 11 is supposed to cooperate with an toy arc building element 10, where the arc toy building element 10 comprises an arch-shaped surface 11 opposite to the arc-surface 12, and the arc surface 12 of the toy arc building element 10 faces away from the bottom surface 1" of the toy arc building elements, and where the arc-surface 12 is a continuously curved surface 13 a from the top surface 1' to the bottom surface 1" of the toy arc building element 10 as defined by the clauses above, then the arch-shaped surface 11 of the separate toy building element having such an arch-shaped surface 11 preferably comprises a vertical planar surface portion and a continuously curved surface portion extending between the vertical planar surface portion and the bottom surface 1". In this case the vertical planar surface portion of the arch-shaped surface 11 has a third length L3, which is ⅗ times the second modular distance P;

if the toy building element having an arch-shaped surface 11 is supposed to cooperate with an toy arc building element 10, where the arc toy building element 10 comprises an arch-shaped surface 11 opposite to the arc-surface 12, and the arc surface 12 of the toy arc building element 10 faces away from the bottom surface 1" of the toy arc building element 10, and where the arc-surface 12 comprises a vertical planar surface portion 14 and a continuously curved surface portion 15 extending between the vertical planar surface portion 12 and the bottom surface 1" as defined by the clauses above, then the arch-shaped surface 11 of the separate toy building element having such an arch-shaped surface 11 is preferably formed as continuously curved surface;

if the toy building element having an arch-shaped surface 11 is supposed to cooperate with an toy arc building element 10, where the arc toy building element 10 comprises an arch-shaped surface 11 opposite to the arc-surface 12, and the arc surface 12 of the toy arc building element 10 faces away from the top surface 1' of the toy arc building element 10, and when the arc-surface 12 is a continuously curved surface 13 from the top surface 1' to the bottom surface 1" of the toy arc building element 10, as defined by the clauses above, then the arch-shaped surface 11 of the separate toy building element having such an arch-shaped surface 11 is further formed with a vertical planar surface portion and a continuously curved surface portion extending between the vertical planar surface portion and the bottom surface 1". In this case the vertical planar surface portion of the arch-shaped surface 11 has a fourth length, L4, which is in the interval ⅖-17/40 times the second modular distance, P; and if the toy building element having an arch-shaped surface 11 is supposed to cooperate with an toy arc building element 10, where the arc toy building element 10 comprises an arch-shaped surface 11 opposite to the arc-surface 12, and the arc surface 12 of the toy arc building elements 10 faces away from the top surface 1' of the toy arc building elements, and when the arc-surface 12 comprises a vertical planar surface portion 14 and a continuously curved surface portion 15 extending between the vertical planar surface portion 12 and the bottom surface 1" as defined by the clauses above, then the arch-shaped surface 11 of the separate toy building element having such an arch-shaped surface 11 is formed as continuously curved surface.

As mentioned above, the improved fit between arc surface 12 and arch-shaped surface 11 is illustrated in FIGS. 6A-B, FIGS. 7-9 and FIG. 12.

FIG. 6A-B shows a system of toy arc building elements 10, each of which toy arc building elements 10 has also an oppositely formed arch-shaped surface 11. FIG. 6B shows this system in a perspective view. In this view it may be appreciated that the width, W, of the toy arc building elements 10 corresponds to one first modular distance, M. However, it will also be appreciated, that in any of the previously described embodiments the width, W of the toy arc building elements 10 may be any desired (integer) multiple of the first modular distance, M.

Turning now to FIG. 7, showing different types of prior art modular toy building elements 1, 2", 3, a toy arc building element 10 and two separate toy building elements 6, 8 having only an arch-shaped surface 11. In FIG. 7 the prior art modular toy building elements and the new toy building elements are combined to form a structure or part of a structure.

The modular toy building element 2" is 1×1 first modular distance, M, i.e. it has 1 knob 120 formed in a top surface 1' and one knob receiving opening 130 formed in a bottom surface 1", and a length, L, and width W of 1 modular distance. The modular toy building element 1' has a height, H, of one second modular distances, P, as defined above. Three such tile-type 1×1 modular toy building element 2" are shown connected on top of each other in FIG. 7. Further, one such tile-type 1×1 modular toy building element 2" is shown next to the three toy building element 2" stack, providing one modular distance, M, of space to the toy building block. The 1×1 modular toy building element 2" is connected via it's knob receiving opening 130 opening and/or knob 120 to other 1×1 modular toy building element 2" or to the toy arc building element 6.

The toy arc building element 10 of FIG. 7 comprises an arch-shaped surface 11 formed as a concave surface in the arc toy building element 10, the arc-shaped surface 11 having an axis of curvature, A1 (see FIG. 5), which is perpendicular to the first direction, D1, defined by the knobs and knob receiving openings, 120, 130. The arch-shaped surface 11 is generally circular or rather cylindrical or partly cylindrical as it stretches over a quarter of a complete cylinder.

The arc toy building element 10 in this case also comprises a convex arc surface 12 formed as a convex surface on the arc toy building element 10 opposite to the arc-shaped surface 11. The convex arc surface 12 also has an axis of curvature, A1 (see FIG. 5), which is perpendicular to the first direction, D1. As with the arc-shaped surface 11, the convex arc surface 12' is generally circular or rather cylindrical or partly cylindrical as it stretches over a quarter of a complete cylinder.

Figure 8:
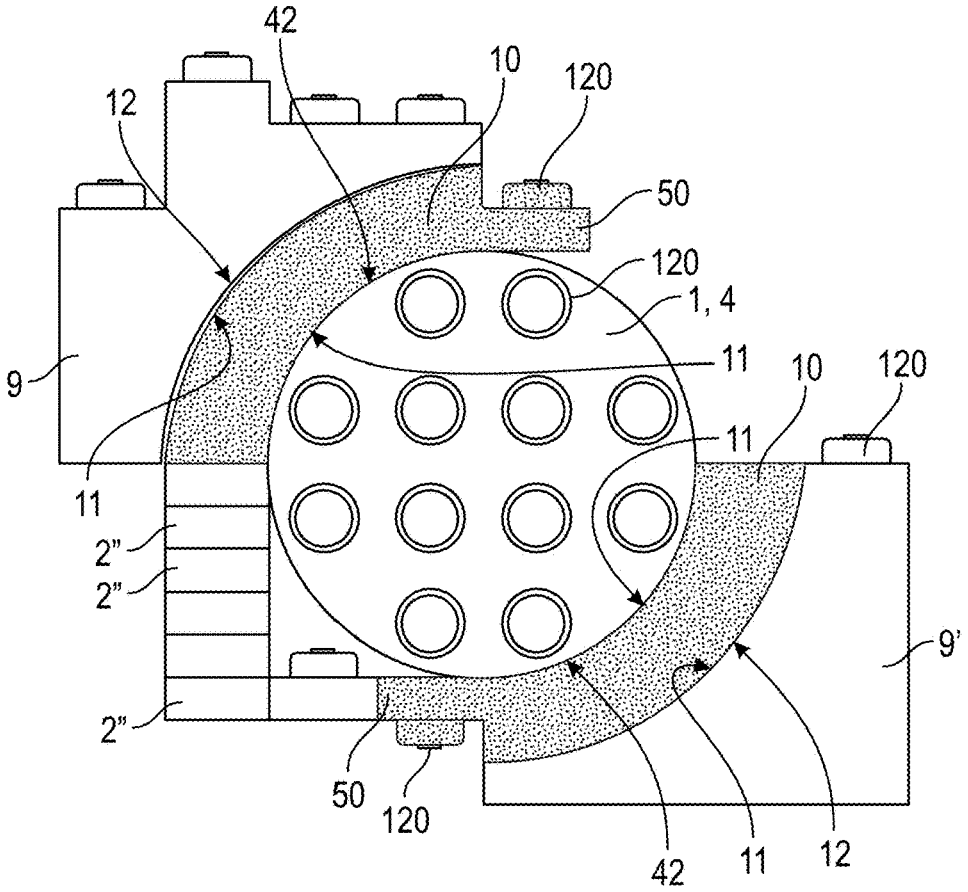
FIG. 8 illustrate another combination of toy arc building elements according to various embodiments of the disclosure with prior art toy building elements.

Turning now to FIG. 8, also showing different types of prior art modular toy building elements 1, 2", two toy arc building element 10 and two separate toy building elements 9, 9' having only an arch-shaped surface 11. In FIG. 8 the prior art modular toy building elements and the new toy building elements are combined to form a structure or part of a structure. The two toy arc building element 10 are shown inverted relative to each other.

Figure 9:
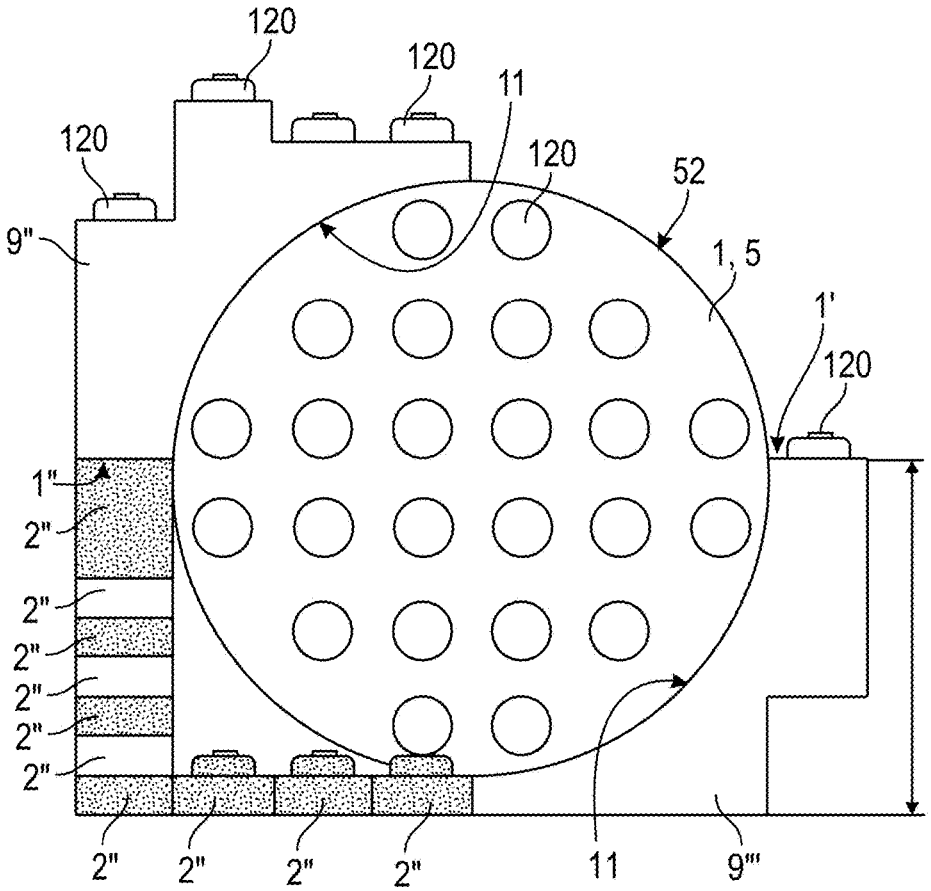
FIG. 9 illustrate yet another combination of toy arc building elements according to various embodiments of the disclosure with prior art toy building elements.

FIG. 9, also shows different types of prior art modular toy building elements 1, 2', 2", 5, and two separate toy building elements 9', 9" having only an arch-shaped surface 11. In FIG. 9 the prior art modular toy building elements and the new toy building elements are combined to form a structure or part of a structure.

FIGS. 7-9 intend to illustrate the achieved improved fit between arc surfaces 12 and arch-shaped surfaces, when provided as explained above.

It is to be noted that the figures and the above description have shown the example embodiments in a simple and schematic manner. Many of the specific mechanical details have not been shown since the person skilled in the art should be familiar with these details and they would just unnecessarily complicate this description.

LIST OF PARTS

A1 axis of curvature of convex arcs and arch-shaped surfaces
D1 First direction/coupling direction
H height of a toy building element (height between the bottom surface and the top surface of a toy building element)
H2 second height (height component of arc surface in a direction transverse to the top surface and/or the bottom surface of the arc toy building element
L length of a toy building element
L2 second length (length component of arc surface in the direction parallel to the bottom surface of the arc toy building element)
m integer multiple of the first modular distance
M first modular distance
p integer multiple of the second modular distance
P second modular distance
R ratio between the integer multiple of the first modular distance of the second length and the integer multiple (p) of the second modular distance of the second height
S modular toy system
W width of a toy building element
1 toy building element
1' top surface of toy building element/top surface of arc toy building element
1" bottom surface of toy building element/bottom surface of arc toy building element
2A toy building element (2×4, 3P toy building element)
2B toy building element (2×4, 3P toy building element)
2' toy building element (1×1, 3P toy building element)
2" toy building element (1×1, 1P toy building element)
10 arc toy building element
10' prior art arc toy building element
11 (concave) arch-shaped surface of toy arc building element
11' (concave) arch-shaped surface of prior art toy arc building element
12 (convex) arc surface of toy arc building element
12' (convex) arc surface of prior art toy arc building element
13 the (convex) arc surface, when it is a continuously curved surface
14 planar surface portion of the (convex) arc surface
15 continuously curved surface portion of the (convex) arc surface
100 (complementary) coupling elements/connector/cylindrical connector (mechanical connection)/complimentary connector
105 body of knob
110 outer cylindrical surface of body of coupling stud/stud/coupling knob/knob
111 downwardly extending tube/cylinder
115 outward surface of downwardly extending tube/cylinder
116 inner surface of sidewall of toy construction element/construction brick
117 elongate ribs 917
120 knob/coupling knob (may also be called studs/coupling stud)
130 knob receiving opening (stud receiving opening)
201 bottom surface of toy building element
203 body part of toy building element
204 top face/top surface of body part of toy building element
205 top wall/upper wall of body part of toy building element
206A sidewall of body part of toy building element (end wall)
206B sidewall of body part of toy building element
206C sidewall of body part of toy building element
206D sidewall of body part of toy building element (end wall)
207 lowermost edge/rim of body part of toy building element
212 lower surface of a top wall of the toy building element/building brick

The invention claimed is:

1. A modular toy system comprising toy building elements, the toy building elements comprising complementary coupling elements in the form of one or more knobs formed on a top surface of at least some of the toy building elements and/or one or more knob receiving openings formed in a bottom surface of at least some of the toy building elements, wherein coupling elements on the toy building elements are arranged to cooperate in a regular two-dimensional pattern on the toy building elements spaced apart by a first modular distance, wherein the toy building elements has a length, which is an integer of the first modular distance, and the toy building elements has a width, which is an integer of the first modular distance, and wherein the toy building elements has a height between the bottom surface and the top surface, which is an integer of a second modular distance, and wherein the second modular distance is ⅖ of the first modular distance, wherein the modular toy system comprises an arc toy building element, the arc toy building element comprising at least one knob receiving opening formed in a bottom surface and/or at least one knob formed in a top surface of the arc toy building element, which is configured for coupling to complimentary coupling elements of another toy building element in a first direction;

an arc surface formed as a convex surface on the arc toy building element, the arc surface having an axis of curvature, which is perpendicular to the first direction, wherein the arc surface extends over a second length in a direction parallel to the top surface or to the bottom surface of the arc toy building element, and a second height in a direction transverse to the bottom surface or to the top surface of the arc toy building element, wherein the second length is an integer multiple of the first modular distance, wherein the second height is an integer multiple of the second modular distance, wherein a ratio is defined between the integer multiple of the second modular distance of the second height, and the integer multiple of the first modular distance of the second length and, wherein the arc surface has a second length of two-eight modular distances and the second height is 5, 7, 10, 12, 15, 17 or 20-times the second modular distance, and when the ratio is 5/2, the arc surface is a continuously curved surface from the top surface to the bottom surface of the toy arc building element, and when the ratio is different from 5/2, but within an interval of 5/2 minus 10%, the arc surface comprises a vertical planar surface portion and a continuously curved surface portion extending between the vertical planar surface portion and the top surface or the bottom surface, the vertical planar surface portion having a third length, which is equal to the second modular distance.

2. The modular toy system according to claim 1, wherein the arc surface is facing away from the bottom surface.

3. The modular toy system according to claim 2, wherein the arc toy building element comprises an arch-shaped surface opposite to the arc-surface.

4. The modular toy system according to claim 3, wherein, when the arc-surface is a continuously curved surface from the top surface to the bottom surface of the toy arc building element, then the arch-shaped surface comprises a vertical planar surface portion and a continuously curved surface portion extending between the vertical planar surface portion and the bottom surface, and wherein the vertical planar surface portion of the arch-shaped surface having a third length, which is 3/5 times the second modular distance.

5. The modular toy system according to claim 3, wherein, when the arc-surface comprises a vertical planar surface portion and a continuously curved surface portion extending between the vertical planar surface portion and the bottom surface, then the arch-shaped surface is a continuously curved surface.

6. The modular toy system according to claim 3, wherein the arch-shaped surface comprises a vertical planar surface portion and a continuously curved surface portion extending between the vertical planar surface portion and the bottom surface, and wherein the vertical planar surface portion of the arch-shaped surface having a third length, which is 3/5 times the second modular distance.

7. The modular toy system according to claim 1, wherein the arc surface is facing away from the top surface.

8. The modular toy system according to claim 7, wherein the arc toy building element comprises an arch-shaped surface opposite to the arc-surface.

9. The modular toy system according to claim 8, wherein, when the arc-surface is a continuously curved surface from the top surface to the bottom surface of the toy arc building element, then the arch-shaped surface comprises a vertical planar surface portion and a continuously curved surface portion extending between the vertical planar surface portion and the bottom surface, and wherein the vertical planar surface portion of the arch-shaped surface having a fourth length, which is in the interval 2/5-17/40 times the second modular distance.

10. The modular toy system according to claim 8, wherein, when the arc-surface comprises a vertical planar surface portion and a continuously curved surface portion extending between the vertical planar surface portion and the bottom surface, then the arch-shaped surface is a continuously curved surface.

11. The modular toy system according to claim 8, wherein the arch-shaped surface comprises a vertical planar surface portion and a continuously curved surface portion extending between the vertical planar surface portion and the bottom surface, and wherein the vertical planar surface portion of the arch-shaped surface having a fourth length, which is in the interval 2/5-17/40 times the second modular distance.

12. A modular toy system comprising toy building elements, the toy building elements comprising:

complementary coupling elements in the form of one or more knobs formed on a top surface of at least some of the toy building elements or one or more knob receiving openings formed in a bottom surface of at least some of the toy building elements, the coupling elements on the toy building elements arranged to cooperate in a regular two-dimensional pattern on the toy building elements spaced apart by a first modular distance, a length and width which are both an integer of the first modular distance, a height between the bottom surface and the top surface, which is an integer of a second modular distance, the second modular distance being 2/5 of the first modular distance, an arc toy building element, the arc toy building element having:

at least one knob receiving opening formed in a bottom surface or at least one knob formed in a top surface configured for coupling to complimentary coupling elements of another toy building element in a first direction;

an arc surface formed as a convex surface on the arc toy building element and extending over a second length in a direction parallel to the top surface or to the bottom surface of the arc toy building element, the second length is an integer multiple of the first modular distance, the arc surface having:

an axis of curvature which is perpendicular to the first direction, a second height in a direction transverse to the bottom surface or to the top surface of the arc toy building element, the second height is an integer multiple of the second modular distance, the second height being 5, 7, 10, 12, 15, 17 or 20-times the second modular distance, and a second length of two to eight modular distances, such that when a ratio between the integer multiple of the second modular distance of the second height and the integer multiple of the first modular distance of the second length is 5/2, the arc surface is a continuously curved surface from the top surface to the bottom surface of the toy arc building element, and when the ratio is different from 5/2, but within an interval of 5/2 minus 10%, the arc surface comprises a vertical planar surface portion and a continuously curved surface portion extending between the vertical planar surface portion and the top surface or the bottom surface), the vertical planar surface portion having a third length, which is equal to the second modular distance.

13. The modular toy system of claim 12, wherein:

the arc surface is facing away from the bottom surface, the arc toy building element comprises an arch-shaped surface opposite to the arc-surface, when the arc-surface is a continuously curved surface from the top surface to the bottom surface of the toy arc building element, the arch-shaped surface comprises a vertical planar surface portion and a continuously curved surface portion extending between the vertical planar surface portion and the bottom surface, and the vertical planar surface portion of the arch-shaped surface having a third length, which is ⅗ times the second modular distance.

14. An arc toy building element for coupling with other toy building elements, the toy building elements arranged to cooperate in a regular two-dimensional pattern spaced apart by a first modular distance, the toy building elements having a length and width which are both an integer of the first modular distance and a height which is an integer of a second modular distance, the second modular distance being ⅖ of the first modular distance, the arc toy building element comprising:

at least one knob receiving opening formed in a bottom surface or at least one knob formed in a top surface configured for coupling to complimentary coupling elements of another toy building element in a first direction;

an arc surface formed as a convex surface on the arc toy building element and extending over a second length in a direction parallel to the top surface or to the bottom surface of the arc toy building element, the second length is an integer multiple of the first modular distance, the arc surface having:

an axis of curvature which is perpendicular to the first direction, a second height in a direction transverse to the bottom surface or to the top surface of the arc toy building element, the second height is an integer multiple of the second modular distance, the second height being 5, 7, 10, 12, 15, 17 or 20-times the second modular distance, and a second length of two to eight modular distances, such that when a ratio between the integer multiple of the second modular distance of the second height and the integer multiple of the first modular distance of the second length is 5/2, the arc surface is a continuously curved surface from the top surface to the bottom surface of the toy arc building element, and when the ratio is different from 5/2, but within an interval of 5/2 minus 10%, the arc surface comprises a vertical planar surface portion and a continuously curved surface portion extending between the vertical planar surface portion and the top surface or the bottom surface, the vertical planar surface portion having a third length, which is equal to the second modular distance.

15. The arc toy building element of claim 14, wherein:

the arc surface is facing away from the bottom surface, the arc toy building element comprises an arch-shaped surface opposite to the arc-surface, when the arc-surface is a continuously curved surface from the top surface to the bottom surface of the toy arc building element, the arch-shaped surface comprises a vertical planar surface portion and a continuously curved surface portion extending between the vertical planar surface portion and the bottom surface, and the vertical planar surface portion of the arch-shaped surface having a third length, which is ⅗ times the second modular distance.

* * * * *